United States Patent [19]

Nagata et al.

[11] Patent Number: 4,868,609

[45] Date of Patent: Sep. 19, 1989

[54] APPARATUS FOR TRANSPORTING SHEETS OF PAPER

[75] Inventors: Kenzo Nagata; Yoichi Kawabuchi, both of Osaka, Japan

[73] Assignee: Minolta Camera Kabushiki Kaisha, Osaka, Japan

[21] Appl. No.: 192,654

[22] Filed: May 11, 1988

[30] Foreign Application Priority Data

May 16, 1987 [JP] Japan ..... 62-119263

[51] Int. Cl.[4] ..... G03G 15/00

[52] U.S. Cl. ..... 355/316; 355/309; 355/203; 355/206

[58] Field of Search ..... 355/3 SH, 14 SH, 3 R, 355/14 CU, 14 C

[56] References Cited

U.S. PATENT DOCUMENTS

| | | | |
|---|---|---|---|
| 4,247,193 | 1/1981 | Kaneko et al. | 355/14 R |
| 4,531,826 | 7/1985 | Stoughton et al. | 355/14 CU |
| 4,750,020 | 6/1988 | Ishizu et al. | 355/14 SH |
| 4,763,160 | 8/1988 | Honjo | 355/3 SH |
| 4,766,463 | 8/1988 | Watanuki et al. | 355/3 SH X |

*Primary Examiner*—A. C. Prescott

*Attorney, Agent, or Firm*—Burns, Doane, Swecker & Mathis

[57] ABSTRACT

A present sheet transporting apparatus for use in a copier measures the time for the sheets to travel a specific distance and corrects a period of time counted by a paper jam detecting timer. Therefore, if slight wear of rollers delays an arrival time of sheet, the apparatus does not detect a jam because such a delay causes no particular trouble to copying operation.

7 Claims, 8 Drawing Sheets

APPARATUS FOR TRANSPORTING SHEETS OF PAPER

BACKGROUND OF THE INVENTION

1. Field of the Invention

The present invention relates to an apparatus for transporting sheets of paper, for example, for use in copying machines, printers and automatic document feeders (ADFs). The present invention also relates to correction of the timer value with time for detecting jams.

2. Description of the Prior Art

For example with copy paper feeding apparatus for copying machines, it is practice to detect paper jams with use of a constant-time timer (hereinafter referred to as a "jam timer").

For example when copy paper fails to reach a specified position (e.g. the position of a sensor provided upstream of a timing roller) within a period of time determined by the jam timer after the feed roller for delivering the copy paper from a paper cassette is initiated into rotation, the failure is interpreted as indicating occurrence of a jam, and the copying machine is brought into a stand-by state or the like for the treatment of the jam.

However, the feed roller is adapted to transport copy paper by friction in pressing contact therewith and thereflore slips when becoming worn, delaying the arrival time of the copy paper and allowing the jam timer to detect a paper jam.

If the wear of the roller is slight, such a delay causes no particular trouble to copying operation, whereas the convention copying machine is stopped by the delay although operable free of trouble, causing inconvenience to the user.

The objection described is not limited only to the use of the roller serving as transport means but is also encountered with other transport means such as conveyor belts when the movable portion wears.

SUMMARY OF THE INVENTION

The main object of the present invention is to provide a paper sheet transport apparatus wherein jams can be detected accurately.

Another object of the invention is to provide a paper sheet transport apparatus wherein jams are detectable properly, for example, even when the transport means wears slightly.

Still another object of the invention is to provide a paper sheet transport apparatus which is best suited to use in copying machines.

These and other objects of the present invention can be fulfilled by an apparatus for transporting sheets of paper which comprises transport means for transporting sheets of paper, means for detecting a jam when the transport means fails to transport the sheet a specified distance within a period of time counted by a timer, means for measuring the time required for the transport means to transport the sheet the specified distance, and means for correcting the period of time counted by the timer based on the time measured by the time measuring means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

An embodiment of the invention will be described below with reference to the drawings.

The present embodiment will be described with reference to an apparatus for use in a copying machine for transporting copy paper from a paper feed assembly to a timing roller.

Figure 1:
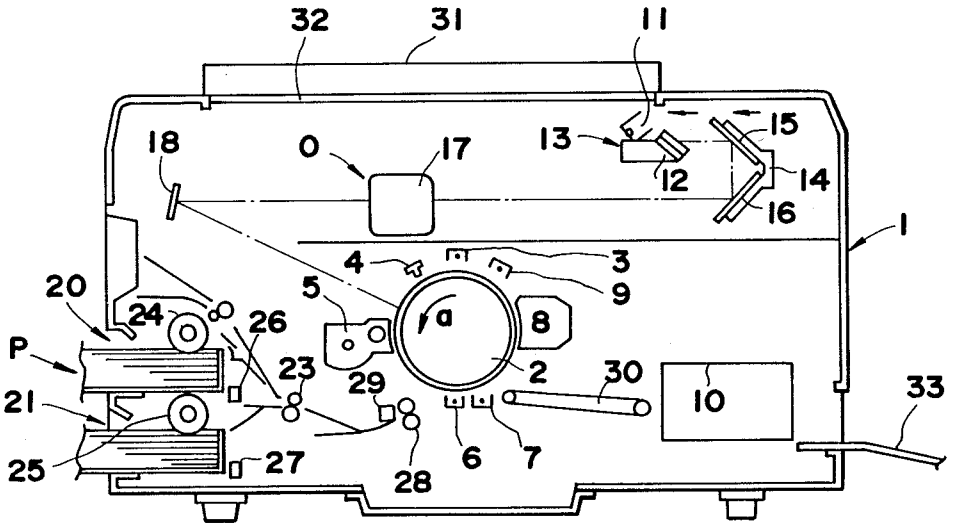
FIG. 1 is a sectional view showing the construction of a copying machine incorporating an embodiment of the invention.

FIG. 1 is a sectional view showing the construction of the copying machine incorporating the embodiment. As seen in FIG. 1, a photosensitive drum 2 is disposed approximately in the center of the copying machine and is drivingly rotated by an unillustrated main motor in the direction of arrow a. Arranged around the drum 2 are a sensitizing charger 3, inter-image area eraser 4, developing unit 5, transfer charger 6, separating charger 7, cleaner 8 and main eraser 9. An optical system O is disposed above the drum 2 and these components, the above-mentioned paper feed assembly P at the left side of the same, and a fixing unit 10 at the right side of the same.

The optical system O comprises a scanning unit 13 of light source 11 and first movable mirror 12, second and third movable mirrors 15, 16 mounted on a common holder 14, a lens 17 and a fixed mirror 18. The image of a document placed between a document holder 31 and a document support glass plate 32 is scanned from below the glass plate 32 for exposure to form an electrostatic latent image on the drum 2. Toner is deposited on the latent image by the developing unit 5.

The paper feed assembly P comprises a first cassette paper feeder 20 and a second cassette paper feeder 21 provided with sensors 26, 27, respectively, each adapted to detect the size of paper accommodated in a cassette installed. A sheet of copy paper is sent out from the feeder by a first feed roller 24 or second feed roller 25 and transported to a timing roller 28 over an intermediate roller 23. The first feeder or the second feeder is selected by a key switch on an unillustrated operation panel provided on the top of front side of the copying machine. A paper jam sensor 29 is disposed close to the timing roller 28 at one side thereof closer to the feeder to produce on ON signal upon detecting the leading end of the paper. The signals emitted by these switch and sensors, etc. are fed to input-output ports of the microcomputer to be described later. The first feed roller 24, the second feed roller 25, the intermediate roller 23, etc. provide a path of transport of paper in the present embodiment, i.e. a paper sheet transport apparatus.

The copy paper sent out from the feeder is fed to the drum 2 by the timing roller 28, with its leading end in register with the forward end of the toner image forming area on the surface of the drum 2.

The toner image is transferred by the transfer charger 6 to the copy paper forwarded by the timing roller 28. The paper is then separated off the drum surface by the separating charger 7 and transported by a conveyor belt 30 to the fixing unit 10, by which the toner is fixed to the paper on melting. The paper is thereafter delivered onto a tray 33 by an unillustrated discharge roller.

Figure 8:
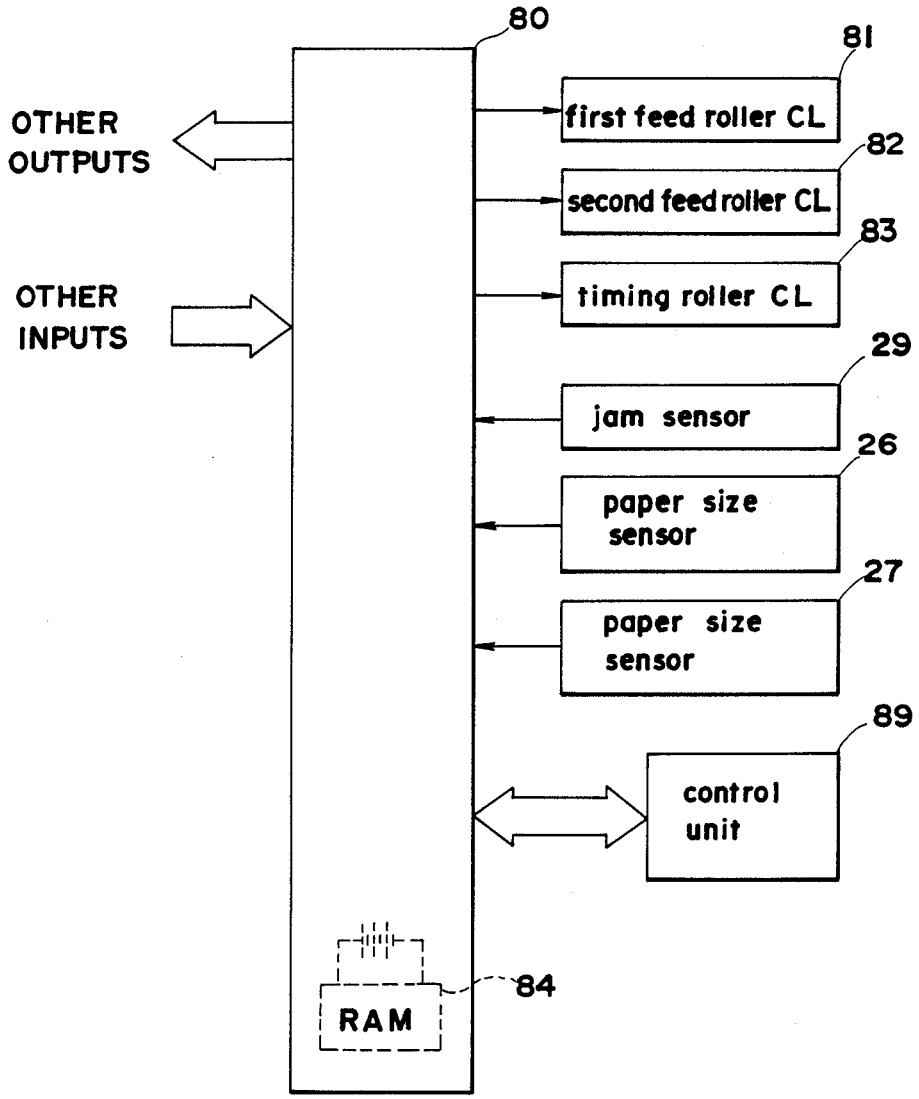
FIG. 8 is a block diagram showing the control circuit of the a paper sheet transport apparatus according to the embodiment.

The copying machine described is controlled by a control system primarily comprising a one-chip microcomputer 80 (hereinafter referred to as "CPU 80") shown in FIG. 8. The paper sheet transport apparatus of the present embodiment is controlled also by the CPU 80 to execute a controller copying operation. The CPU 80, which has a RAM 84 backed up with a battery, is provided with output ports having connected thereto a first feed roller clutch 81, a second feed roller clutch 82 and a timing roller clutch 83 for transmitting a torque to the first feed roller 24, the second feed roller 25 and the timing roller 28, respectively. Each of these clutches, when engaged, transmits the torque to the roller concerned. The CPU 80 has input ports for receiving detection signals from the paper size sensors 26, 27 and the paper jam sensor 29 and further has other input and output ports connected to key switches of a control unit 89 and a control circuit for the sensitizing charger 3, the transfer charger 6 and other components, the main motor, etc.

Figure 2:
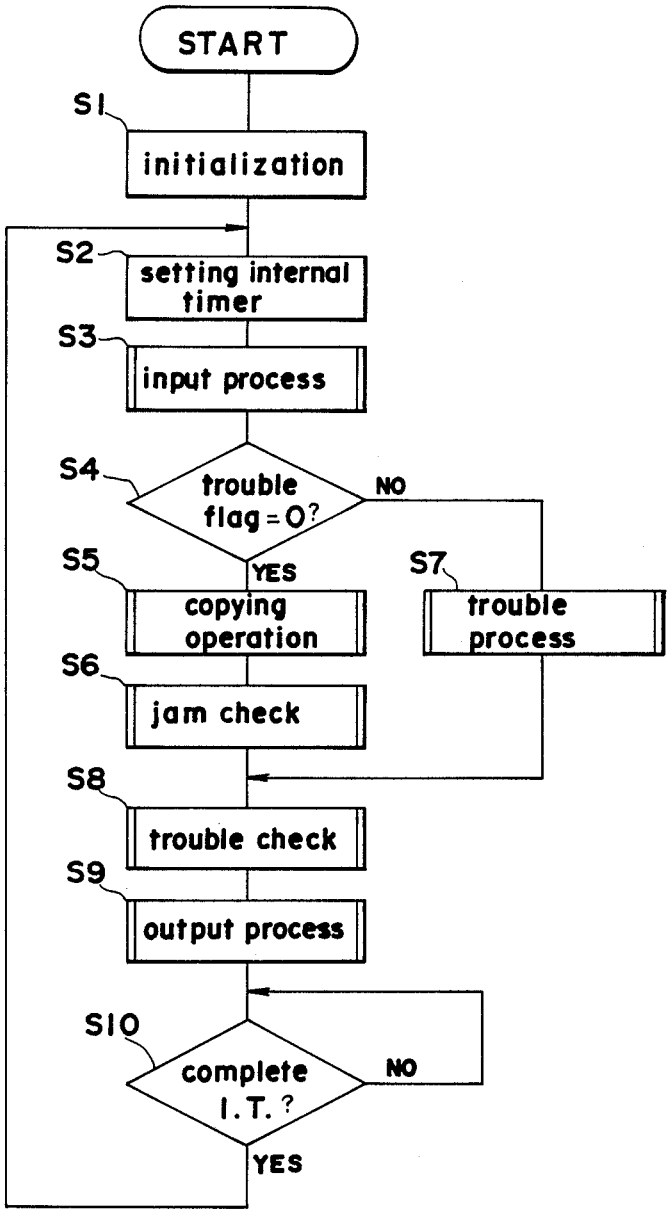
FIG. 2 is a main flow chart generally showing the process to be executed by a microcomputer.

FIG. 2 is a main flow chart generally showing the process to be executed by the CPU 80.

Before describing the flow chart, the terms "on edge" and "off edge" will be defined.

The term "on edge" means a change in the state of a switch, sensor, signal or the like from OFF state to ON state.

The term "off edge" refers to a change in the state of a switch, sensor, signal or the like from ON state to OFF state.

Timers, registers or input and output ports of the CPU 80 are set to the initial state in step S1, for example, by turning on the power supply.

In step S2, an internal timer is set for determining the time required for the following control process, i.e., for one routine of control process. In step S3, inputs from the control unit 89, switches, sensors, etc. are processed.

In step S4, a trouble flag is checked, which is set when a trouble is detected in the copying machine in the trouble checking routine to be described later. When the machine is free of trouble, that is, when the trouble flag is 0, step S5 follows, whereas if the machine is in trouble, i.e., if the trouble flag is 1, the sequence proceeds to step S7.

A copying operation processing routine (to be described later with reference to FIG. 3) is performed in step S5. The paper being transported by the transport apparatus is checked for a jam by the routine of step S6 (to be described with reference to FIG. 4). Step S7 is the routine to be performed in the event of a trouble and is followed by step S8.

Step S9 is a routine for processing control signal, display signal and like outputs and others.

When the operation of the internal timer set in step S2 has been completed in step S10, the sequence returns to step S2.

Figure 3:
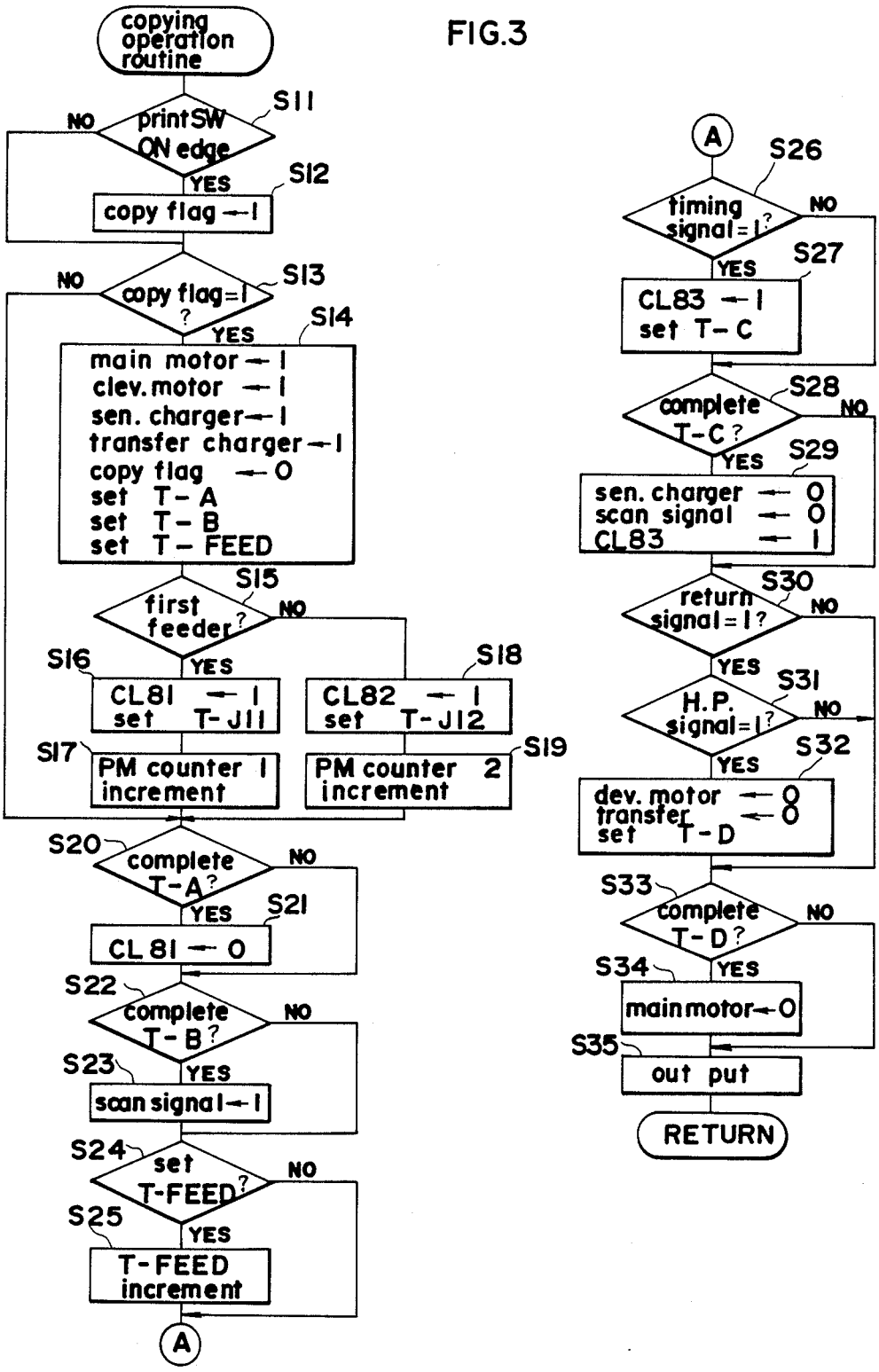
FIG. 3 is a flow chart showing the copying operation of step S5 of FIG. 2 in detail.

FIG. 3 is a flow chart showing the copying operation subroutine of step S5 of FIG. 2.

When the print switch on the unillustrated operation panel is found to be on edge in step S11, a copy flag is set to "1" in step S12. If otherwise, step S11 is directly followed by step S13.

When the copy flag is found to be "1" in step S13, the main motor, developing motor, sensitizing charger 3, transfer charger 6, etc. are energizing, the copy flag is reset to "0", and a timer A, timer B and timer FEED are set in step S14. The timer A determines when to stop the first or second feed roller. The timer B determines when to initiate the optical system O into exposure scanning operation. The timer FEED measures the period of time from the start of rotation of the first or second feed roller until the leading end of copy paper is detected by the jam sensor 29. Subsequently, step S15 inquires whether the first feeder has been selected. If the inquiry is answered in the negative, indicating that the second feeder has been selected, the feed roller for this feeder is actuated. More specifically, when the first feeder has been selected, the first feed roller clutch 81 is engaged to actuate the first feed roller 24, and a timer J11 is set in step S16, and a PM counter 1 is advanced by an increment in step S17. The PM counter 1 counts how many times the timer FEED has measured the time period of transport of copy paper by the first feed roller. The count value obtained by this counter is stored in the RAM 84 backed up with a battery and therefore will not disappear even if the power supply for the copying machine is turned off. The same can be said of the timer value buffer area to be described later. The timer J11 is a jam checking timer, which will be described in detail later with reference to the jam checking routine. If the first feeder is not the selected one (step S15), the second feed roller clutch 82 is engaged to drive the second feed roller 25, and a timer J12 is set in step S18, followed by step S19 to increment a PM counter 2.

Step S20 checks the timer A for the completion of its operation. If the answer is affirmative, the feed roller clutch 81 or 82 in operation is disengaged in step S21.

Step S22 checks the timer B for the completion of its operation. When the answer is affirmative, an exposure scanning signal is produced in step S23.

When the timer FEED is found to be set in step S24, the timer FEED is incremented in step S25.

A timing signal is found to be "1" in step S26, whereupon the timing roller clutch 83 is engaged to drive the timing roller 28, and a timer C is set in step S27. The timing signal is produced upon the scanning unit 13 reaching a specified position.

On completion of operation of the timer C in Step S28, the sensitizing charger 3, scanning signal and timing roller clutch 83 are turned off in step S29.

With a return signal in "1" state in step S30, the scanning unit 13 in return travel actuates an unillustrated switch to indicate that it has returned to the home position (step S31), whereupon the developing motor and the transfer charger 6 are turned off, and a timer D is set in step S32.

On completion of operation of the timer D in step S33, the main motor is deenergized in step S34. The result achieved by the process thus executed is output in step S35.

Figure 4:
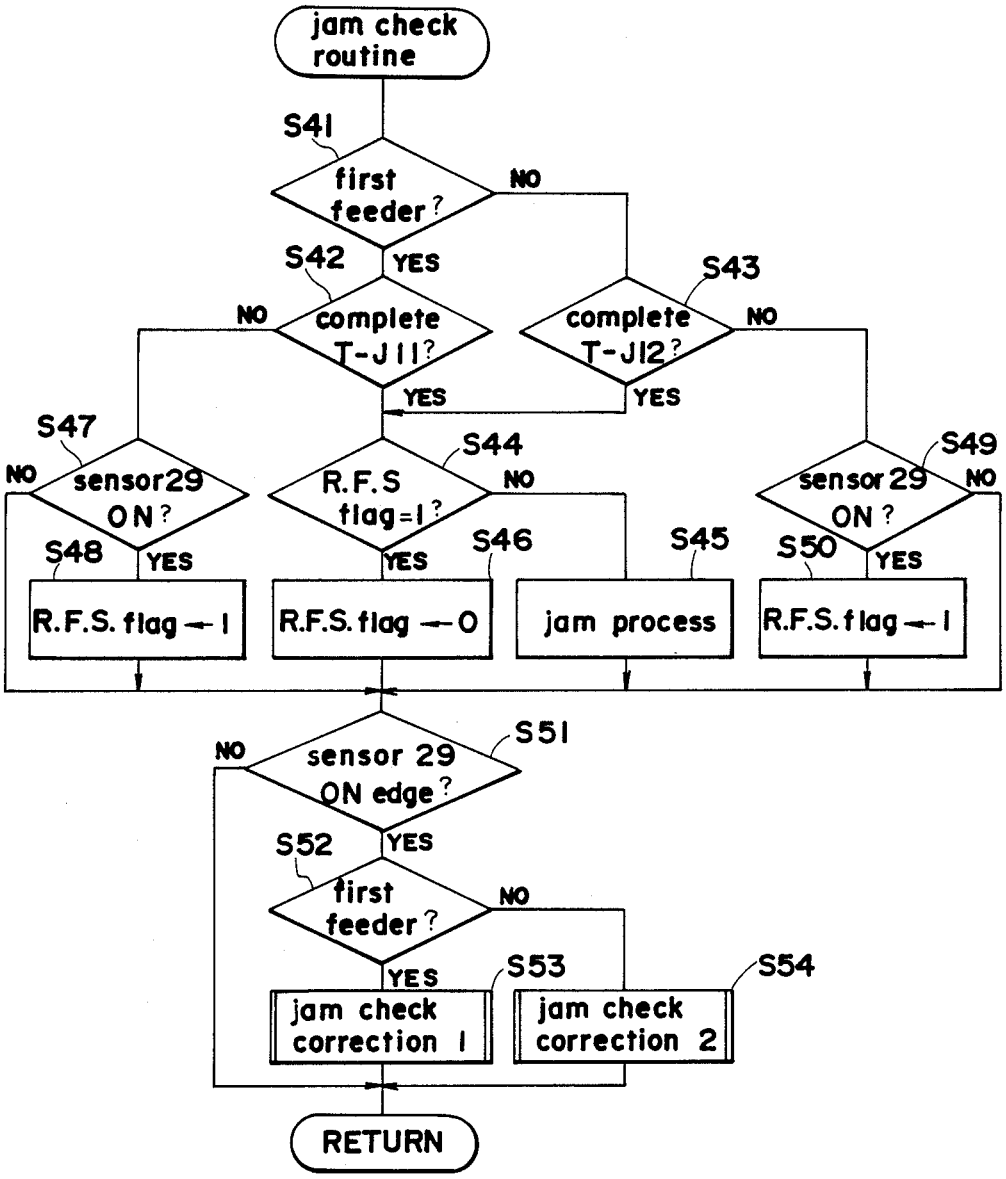
FIG. 4 is a flow chart showing the jam checking routine of step S6 of FIG. 2 in detail.

FIG. 4 is a flow chart showing the jam checking routine of step S6.

Step S41 inquires which of the first and second feeders has been selected. If the first feeder is the selected one, the timer J11 is checked in step S42.

When the timer J11 or timer J12 is found to be still in operation in step S42 or S43, step S47 or S49 inquires whether the paper jam sensor 29 is on, i.e., whether the copy paper has been detected. When the answer is affirmative, a roller front sensor flag is set to "1" in step S48 or step S50. Thus, the roller front sensor flag is such that it is set to "1" when the copy paper has reached the paper jam sensor 29 within the period of time determined by the timer J11 or J12 after the start of feed of the copy paper. The machine is checked for a jam with reference to the state of this flag.

On the other than, if the roller front sensor flag is not found to be "1" in step S44, that is, if the copy paper has not been detected by the sensor 29, despite the completion of operation of the timer J11 or J12 recognized in step S42 or S43, this is interpreted as indicating a paper jam, and a jam treatment is conducted in step S45. When the detection of the copy paper by the sensor 29 is recognized in step S44, the roller front sensor flag is changed to "0" in step S46.

When the paper jam sensor 29 is found to be on edge in step S51, the feeder selected is identified in step S52. When the first feeder is the selected one, step S53 follows. If the second feeder is the selected one, step S54 follows.

Steps S53 and S54 will be described with reference to FIGS. 5 and 6, respectively.

Figure 5:
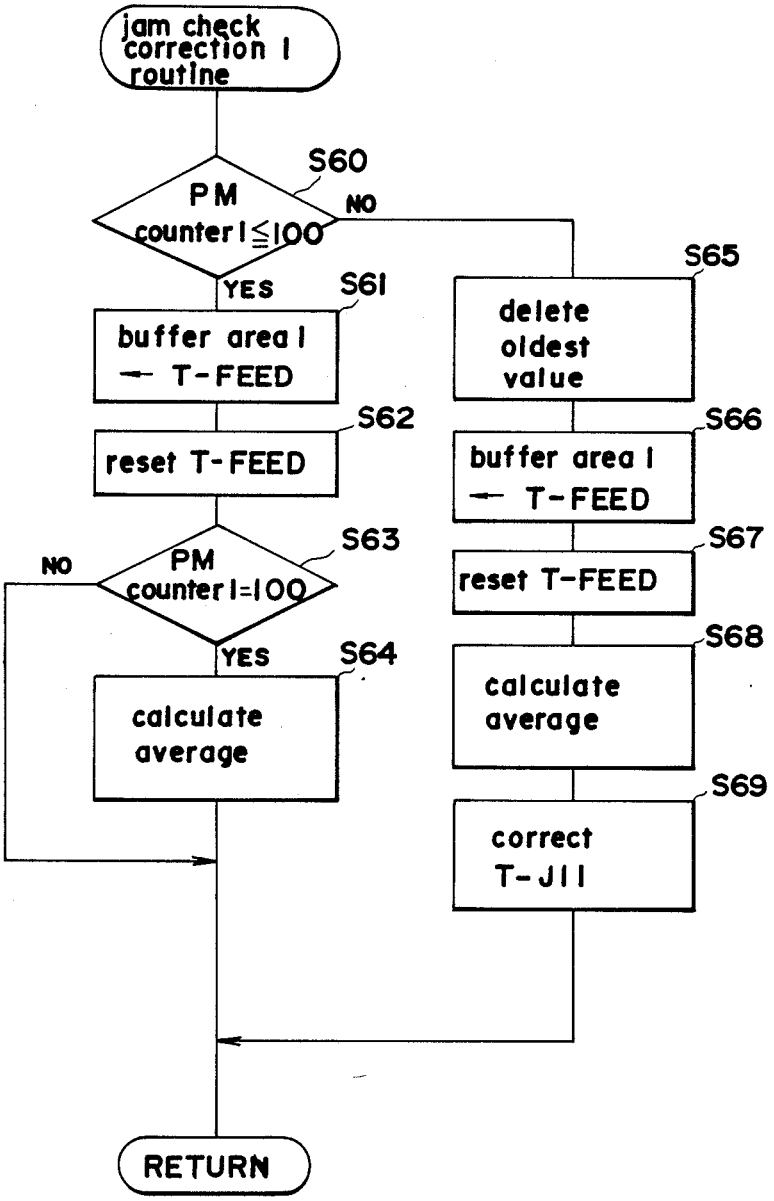
FIG. 5 is a flow chart showing the jam check correction 1 routine of step S53 in FIG.4 in detail.

FIG. 5 is a flow chart showing the jam check correction 1 routine of step S53 of FIG. 4 in greater detail. The current value of the timer FEED set (to "0") in step S14 of FIG. 3 and incremented in step S25 approximately corresponds to the time required for the copy paper to travel from the feed roller to the timing roller. In the present routine, 100 such current values are stored in a timer value buffer area 1 until the count of the PM counter 1 reaches 100 (steps S60 to S62). Upon the PM counter 1 counting up 100 (step S63), the means of the values stored in the timer value buffer area 1 is calculated (step S64). Upon the count on the PM counter 1 exceeding 100, the oldest value in the buffer area 1 is replaced by the new current value, and the mean of the renewed values in the buffer area 1 is determined (steps S65 to S68).

The renewed current mean value is then compared with the previous mean value, and the value of the jam checking timer J11 is corrected by an amount corresponding to the difference therebetween so as to be in conformity the renewed mean value (step S69).

Figure 6:
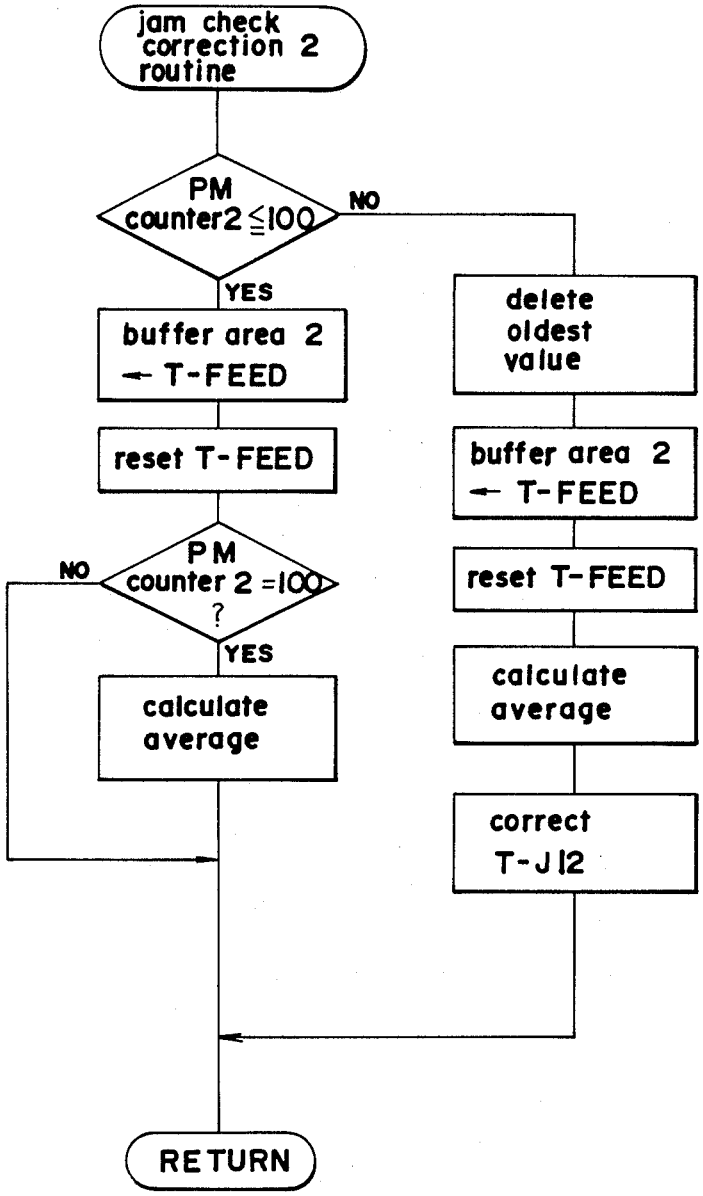
FIG. 6 is a flow chart showing the jam check correction 2 routine of step S54 in FIG. 4 in detail.

FIG. 6 is a flow chart showing the jam check correction 2 rountine of step S54 of FIG. 1 in detail. In this routine, values of the timer FEED are stored in a timer value buffer area 2 with an increase in the count on the PM counter 2 to correct the value of the jam checking timer J12 substantially in the same manner as in the correction 1 routine.

Figure 7:
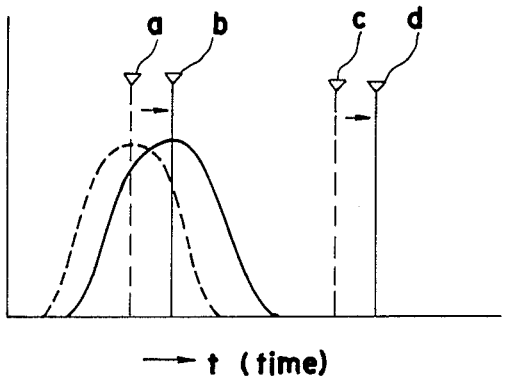
FIG. 7 is a graph showing the relationship between a change in data distribution within a timer value buffer area and the correction of a jam check timer value.

For illustrative purposes, FIG. 7 shows the relationship between the change in the distribution of data (values of the timer FEED) stored in the timer value buffer area and correction of the jam checking timer value made by the procedure of FIG. 5. The illustrated curve in broken line represents the distribution of previous values of the timer FEED, and indicated at a is the mean of these values. The curve in broken line represents the distribution of current values of the timer FEED, and designated at b is the mean thereof. With the change from a to b in the mean value, the value of the jam checking timer J11 or J12 is corrected from c to d by the jam check correction routine described. In this case, the values of the timer FEED have a normal distribution the shape of which remains unchanged with time.

Other Embodiments

Although the data as to the paper arrival time (values of the timer FEED) is used in the form of a mean value in the embodiment described above, also useful will be the following values.

(1) Median or mode.

(2) Value approximate to maximum.

(3) Combination of mean value, dispersion value and the like.

The value (1) is effective, for example, when the data is not of normal distribution, while (2) and (3) are useful, for example, when the data is widely spread although the mean value does not change greatly.

Although 100 items of data preceding the latest data are used in the foregoing embodiment, also usable are: (4) All items of data. (5) Data sampled at a given interval.

Whereas the data (4) in its entirety is less susceptible to the influence of the singular point, an increased number of data items requires a longer processing time. Although the data (5) exerts a lesser influence on the control time of the machine than when every item of data is processed, this method is less responsive to variations in data.

When the value of the PM counter 1 is smaller than 100 in the above embodiment, steps S64 and S65 to S69 are not performed because the mean value will not be a reliable value if the number of sampled items of data is small.

Timer FEED values are useful not only for correcting the value of the jam checking timer. For example, when the mean of values of the timer FEED exceeds a predetermined value, a request for the replacement of the feed roller may be displayed for the maintenance of the machine. When the feed roller is replaced in this case, it is necessary to clear the contents of the backed-up RAM.

With the paper sheet transport apparatus of the invention described, the set timer value serving as a reference for detecting a jam can be corrected with variations in the time required for transporting paper, for example, due to the wear of the roller. According to the invention, therefore, the influence of the wear of the roller, for example, is limited merely to a somewhat impaired transport function and does not lead to a stop of the transport function or the overall apparatus that could result from the detection of a jam. This assures the user of convenience The expedient provided by the invention also serves to render the roller usable for a longer period of time before replacement and to reduce the frequency of maintenance.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An apparatus for transporting sheets of paper comprising:

means for transporting the sheets of paper one by one;

timer means for counting a period of time for said transport means to transport the sheets a specified distance;

means for detecting a jam when said transport means fail to transport the sheet the specified distance within the period of time counted by said timer means;

means for measuring the time required for the transport means to transport the sheet the specified distance; and means for correcting the period of time counted by the timer means based on the time measured by said measuring means;

2. An apparatus as claimed in claim 1, wherein said measuring means included memory means for storing the measured time, and said correcting means corrects the period of time counted by the timer based on the time stored by memory means.

3. An apparatus as claimed in claim 2, wherein said memory means is non-volatility.

4. An apparatus for transporting sheets of paper comprising:

means for transporting sheets of paper one by one;

timer means for counting a period of time for said transport means to transport the sheet a specified distance;

means for detecting a jam when said transport means fail to transport the sheet the specified distance within the period of time counted by said timer means;

means for measuring the time required for the transport means to transport the sheet the specified distance;

means for storing values corresponding to the periods of the measured time of the preceding sheets which have been transported by said transport means; and means for correcting the period of time counted by the timer means based on the values which are stored by said storing means.

5. An apparatus as claimed in claim 4, wherein said correcting means includes means for calculating an average value of the values stored by said storing means, and said correcting means corrects the period of the time counted by the timer means based on the average value.

6. An apparatus as claimed in claim 5, wherein said storing means is a non-volatile memory.

7. An apparatus for transporting sheets of paper from a paper feed portion to an image forming portion one by one in a copying machine, said apparatus comprising:

means for feeding the sheets from the paper feeding portion to the image forming portion one by one;

timer means for counting a period of time for said feeding means to feed the sheet a specified distance from the paper feed portion;

means for detecting a jam when said feeding means fail to feed the sheet the specified distance within the period of time counted by said timer means;

means for measuring the time required for the feeding means to feed the sheet the specified distance from paper feed portion; and means for correcting the period of time counted by the timer means based on the time measured by said measuring means.

* * * * *